US009512558B1

(12) United States Patent
Eckerman

(10) Patent No.: US 9,512,558 B1
(45) Date of Patent: Dec. 6, 2016

(54) ANIMATED CLOTHES CONTAINER

(71) Applicant: Scott Eckerman, Saratoga, CA (US)

(72) Inventor: Scott Eckerman, Saratoga, CA (US)

( * ) Notice: Subject to any disclaimer, the term of this patent is extended or adjusted under 35 U.S.C. 154(b) by 0 days.

(21) Appl. No.: 14/709,222

(22) Filed: May 11, 2015

(51) Int. Cl.

| | |
|---|---|
| ***B65D 43/26*** | (2006.01) |
| ***D06F 95/00*** | (2006.01) |
| ***B65D 21/08*** | (2006.01) |
| ***B65D 33/02*** | (2006.01) |

(52) U.S. Cl.
CPC ..... *D06F 95/002* (2013.01); *B65D 21/086* (2013.01); *B65D 33/02* (2013.01); *B65D 43/26* (2013.01)

(58) Field of Classification Search
CPC ..... D06F 95/002; B65D 21/086; B65D 33/02; B65D 43/26; A47G 29/22
USPC ..... 220/9.2; 232/1 B, 47, 48, 51, 52
See application file for complete search history.

(56) References Cited

U.S. PATENT DOCUMENTS

| | | | | |
|---|---|---|---|---|
| 386,757 | A * | 7/1888 | Regester | A47G 29/16 232/51 |
| 428,968 | A * | 5/1890 | Snead | A47G 29/1209 232/48 |
| D349,372 | S | 8/1994 | Bird et al. | |
| 5,522,729 | A | 6/1996 | Maddox | |
| D383,266 | S * | 9/1997 | Emanoff | D21/603 |
| 5,700,293 | A * | 12/1997 | Rydell | D06F 95/002 232/1 B |
| 6,299,061 | B1 * | 10/2001 | Henson | A47G 29/22 232/33 |
| 6,892,897 | B2 * | 5/2005 | Stewart | B65D 37/00 220/213 |
| 7,570,003 | B2 | 8/2009 | Chan | |
| 8,070,006 | B2 * | 12/2011 | Austin | B65F 1/004 220/4.28 |
| 8,820,567 | B2 | 9/2014 | Cutler | |
| 2004/0155038 | A1 * | 8/2004 | Smith | B65D 37/00 220/9.2 |
| 2008/0006637 | A1 * | 1/2008 | Feeney | D06F 95/002 220/495.06 |
| 2008/0113583 | A1 | 5/2008 | Guzman et al. | |
| 2014/0273717 | A1 | 9/2014 | Judkins et al. | |

FOREIGN PATENT DOCUMENTS

| | | |
|---|---|---|
| GB | 2224922 | 5/1990 |
| GB | 2228400 | 8/1990 |

* cited by examiner

*Primary Examiner* — Fenn Mathew
*Assistant Examiner* — Robert Stodola
(74) *Attorney, Agent, or Firm* — Patent Law Offices Michael E. Woods; Michael E. Woods

(57) ABSTRACT

An amusement system and method for adding an element of playfulness to placing used/soiled clothing within a hamper or other clothing container. A non-motorized mechanical flapper mechanism is rotationally coupled to an opening of a clothing hamper. The flapper mechanism is biased into a reception mode such that placement of soiled clothing on a target panel rotates the target panel to deposit the clothing into the hamper and the biasing mechanism returns the target panel to the reception mode automatically after deposit. An F/X module may be used to add effects to the transitions of the target panel.

5 Claims, 6 Drawing Sheets

ANIMATED CLOTHES CONTAINER

FIELD OF THE INVENTION

The present invention relates generally to a clothing container, and more specifically, but not exclusively, to an animated clothing hamper for children.

BACKGROUND OF THE INVENTION

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

Many parents, caregivers, and custodians of children have a desire to educate and instill them with a desire to pick up used/soiled clothing that often is distributed throughout a living space. Many educators suggest that adding an element of playfulness to certain tasks may help improve compliance from children.

What is needed is a system and method for adding an element of playfulness to placing used/soiled clothing within a hamper or other clothing container.

BRIEF SUMMARY OF THE INVENTION

Disclosed is a system and method for adding an element of playfulness to placing used/soiled clothing within a hamper or other clothing container.

The following summary of the invention is provided to facilitate an understanding of some of the technical features related to an animated clothing hamper, and is not intended to be a full description of the present invention. A full appreciation of the various aspects of the invention can be gained by taking the entire specification, claims, drawings, and abstract as a whole. The present invention is applicable to other containers for other articles in addition to soiled clothing, such as a toy bin or the like.

An illustrated embodiment of the present invention includes one or more of the following features: 1) a mechanically-animated, thematically characterized cloths hamper for children including a body (e.g., a lower housing) and a mouth (e.g., an upper housing); 2) a non-motorized mechanical lever that pivots the mouth closed as it receives a weighted external object (e.g. piece of laundry); 3) the external object is deposited into the body as it falls from the pivoting mouth, and the mouth pivots/returns back to the open, receptive position responsive to a biasing/restorative force on the mouth; 4) this biasing force acts as a return mechanism connecting the mouth to the body and pulls the mouth back into the resting position by a this biasing structure, for example an elastic strap or spring component; 5) the biasing structure is adjustable allowing user to fine-tune the return mechanism (for faster or slower animation pivot effect); 6) optionally the body includes a relatch-able opening in a bottom panel for easy-access to laundry load (without requiring it be pulled back through the upper opening; 7) there is an optional latching mechanism that includes a relatch-able structure to close and hold the mouth closed (held under tension against the biasing structure) when not in use; 8) one or both of the housings are designed with an internal spring mechanism to be collapsible when in package and for longer-term storage; and 9) an optional effects module may provide an electronic audio phrase(s) and/or visual cue with each mouth closing event.

An animated clothing hamper, including a body including a base, a sidewall extending from the base and defining an interior volume and an opening opposite of the base; and a flapper mechanism, coupled to the opening, including a cover, a target panel pivotally coupled within the opening without an electric motor and having a reception mode and a closed mode, and a biasing structure coupled to the target panel and to a portion of the sidewall biasing the target panel to the reception mode; wherein the reception mode includes the target panel lying in a first plane generally parallel relative to an opening plane including the opening; and wherein the closed mode includes the target panel lying in a second plane inclined relative to the opening plane.

A method, including the steps of a) adding an article of clothing onto a target panel pivotally coupled to an opening accessing a storage volume of a clothing hamper, the target panel including a reception mode for receipt of the article of clothing; b) inclining, without use of an electric motor, the target panel into the storage volume responsive to the article of clothing added onto the target panel, the target panel including a closed mode for depositing the article of clothing into the storage volume; c) depositing the article of clothing into the storage volume responsive to the inclination of the target panel in the closed mode; d) declining, without use of an electric motor, the target panel from the storage volume responsive to the article of clothing being deposited into the storage volume until the target panel returns automatically to the reception mode.

Any of the embodiments described herein may be used alone or together with one another in any combination. Inventions encompassed within this specification may also include embodiments that are only partially mentioned or alluded to or are not mentioned or alluded to at all in this brief summary or in the abstract. Although various embodiments of the invention may have been motivated by various deficiencies with the prior art, which may be discussed or alluded to in one or more places in the specification, the embodiments of the invention do not necessarily address any of these deficiencies. In other words, different embodiments of the invention may address different deficiencies that may be discussed in the specification. Some embodiments may only partially address some deficiencies or just one deficiency that may be discussed in the specification, and some embodiments may not address any of these deficiencies.

Other features, benefits, and advantages of the present invention will be apparent upon a review of the present disclosure, including the specification, drawings, and claims.

BRIEF DESCRIPTION OF THE DRAWINGS

The accompanying figures, in which like reference numerals refer to identical or functionally-similar elements throughout the separate views and which are incorporated in and form a part of the specification, further illustrate the present invention and, together with the detailed description of the invention, serve to explain the principles of the present invention.

DETAILED DESCRIPTION OF THE INVENTION

Figure 1:
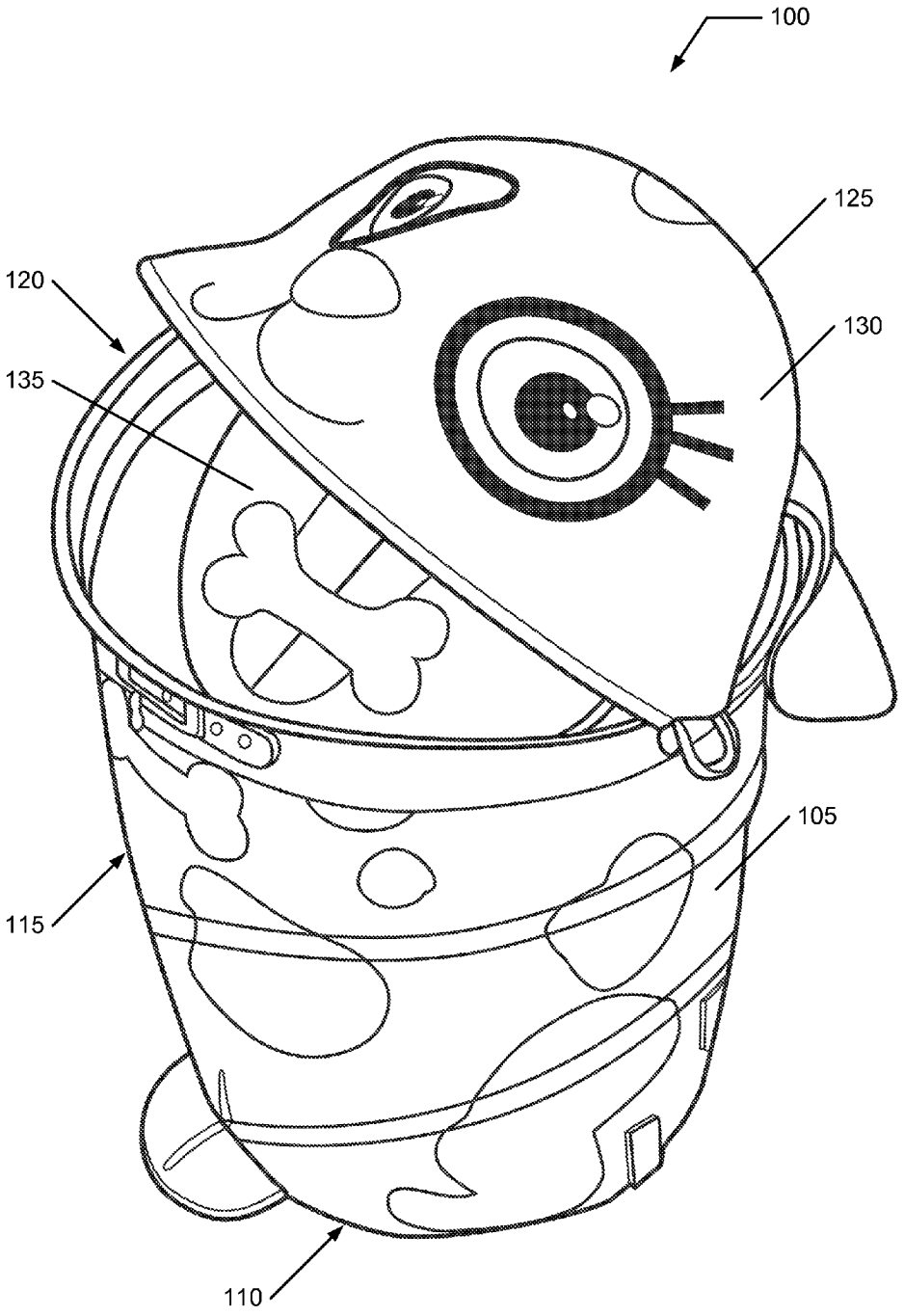
FIG. 1 illustrates a front perspective view of an animated clothing hamper in a reception mode.

Embodiments of the present invention provide an amusement system and method for adding an element of playfulness to placing used/soiled clothing within a hamper or other clothing container. The following description is presented to enable one of ordinary skill in the art to make and use the invention and is provided in the context of a patent application and its requirements.

Various modifications to the preferred embodiment and the generic principles and features described herein will be readily apparent to those skilled in the art. Thus, the present invention is not intended to be limited to the embodiment shown but is to be accorded the widest scope consistent with the principles and features described herein.

DEFINITIONS

Unless otherwise defined, all terms (including technical and scientific terms) used herein have the same meaning as commonly understood by one of ordinary skill in the art to which this general inventive concept belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

The following definitions apply to some of the aspects described with respect to some embodiments of the invention. These definitions may likewise be expanded upon herein.

As used herein, the term "or" includes "and/or" and the term "and/or" includes any and all combinations of one or more of the associated listed items. Expressions such as "at least one of," when preceding a list of elements, modify the entire list of elements and do not modify the individual elements of the list.

As used herein, the singular terms "a," "an," and "the" include plural referents unless the context clearly dictates otherwise. Thus, for example, reference to an object can include multiple objects unless the context clearly dictates otherwise.

Also, as used in the description herein and throughout the claims that follow, the meaning of "in" includes "in" and "on" unless the context clearly dictates otherwise. It will be understood that when an element is referred to as being "on" another element, it can be directly on the other element or intervening elements may be present therebetween. In contrast, when an element is referred to as being "directly on" another element, there are no intervening elements present.

As used herein, the term "set" refers to a collection of one or more objects. Thus, for example, a set of objects can include a single object or multiple objects. Objects of a set also can be referred to as members of the set. Objects of a set can be the same or different. In some instances, objects of a set can share one or more common properties.

As used herein, the term "adjacent" refers to being near or adjoining. Adjacent objects can be spaced apart from one another or can be in actual or direct contact with one another. In some instances, adjacent objects can be coupled to one another or can be formed integrally with one another.

As used herein, the terms "connect," "connected," and "connecting" refer to a direct attachment or link. Connected objects have no or no substantial intermediary object or set of objects, as the context indicates.

As used herein, the terms "couple," "coupled," and "coupling" refer to an operational connection or linking. Coupled objects can be directly connected to one another or can be indirectly connected to one another, such as via an intermediary set of objects.

As used herein, the terms "substantially" and "substantial" refer to a considerable degree or extent. When used in conjunction with an event or circumstance, the terms can refer to instances in which the event or circumstance occurs precisely as well as instances in which the event or circumstance occurs to a close approximation, such as accounting for typical tolerance levels or variability of the embodiments described herein.

As used herein, the terms "optional" and "optionally" mean that the subsequently described event or circumstance may or may not occur and that the description includes instances where the event or circumstance occurs and instances in which it does not.

Figure 2:
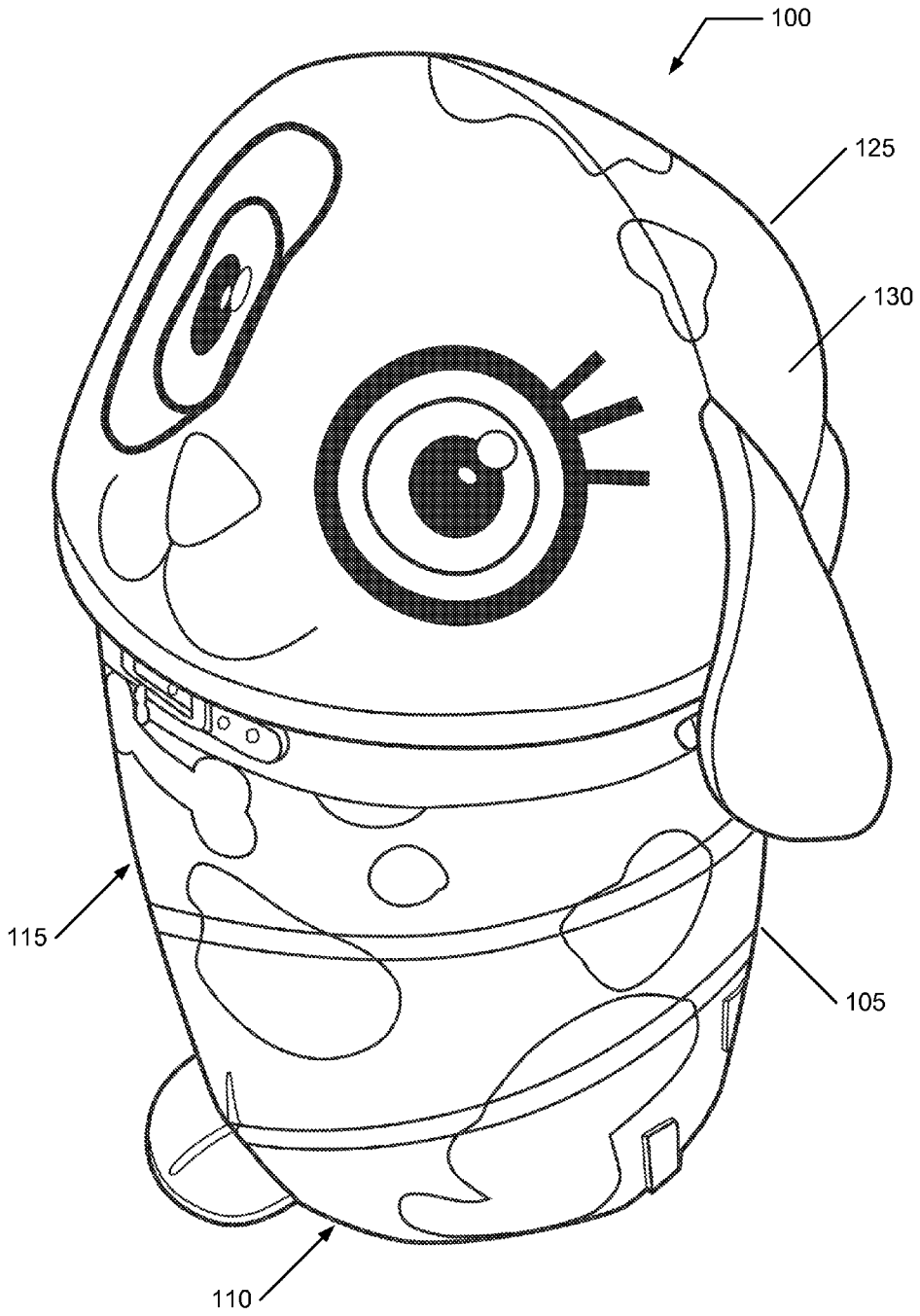
FIG. 2 illustrates a front perspective view of the animated clothing hamper in a closed mode.
Figure 3:
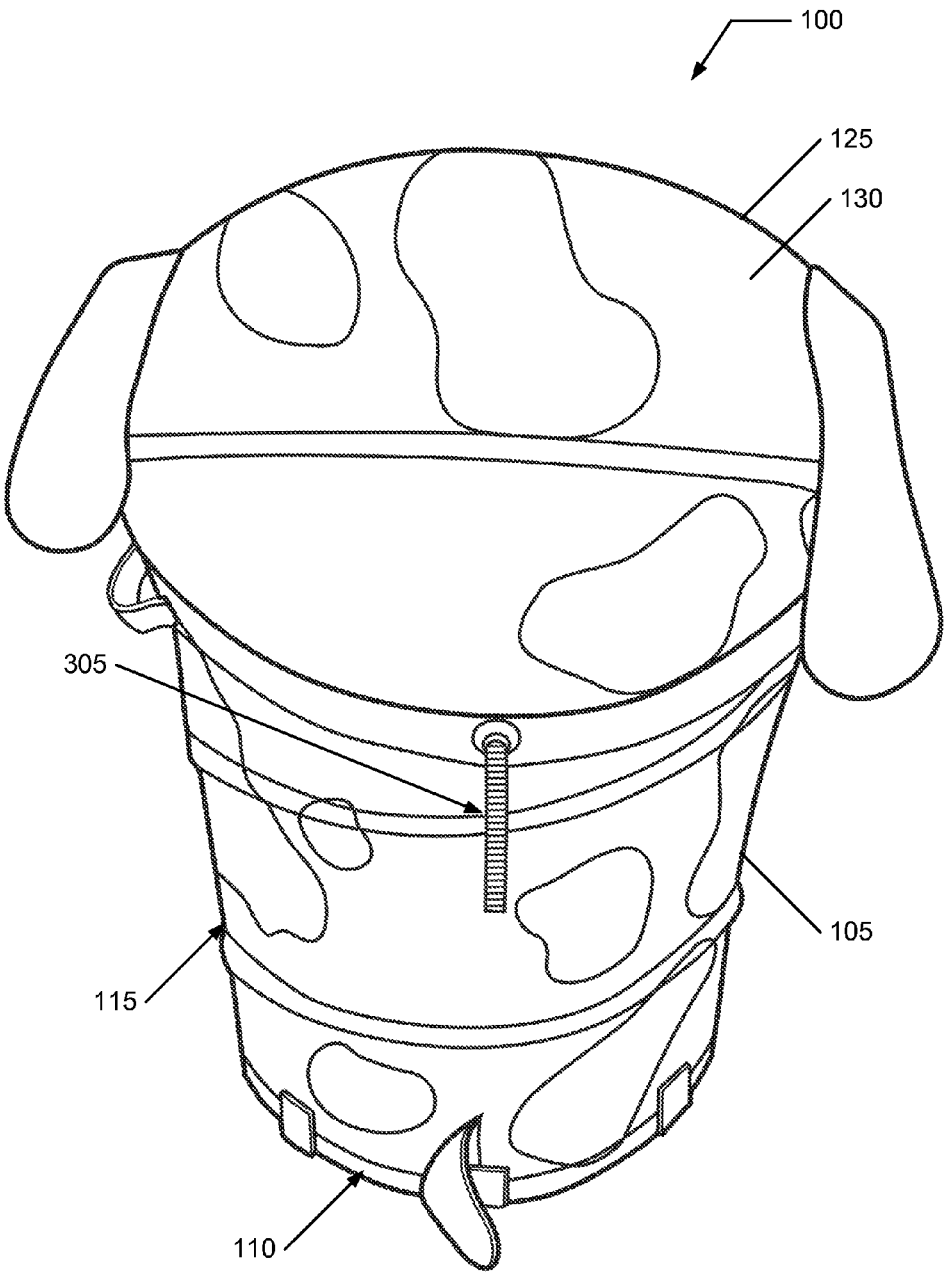
FIG. 3 illustrates a rear perspective view of the animated clothing hamper in the closed mode.
Figure 4:
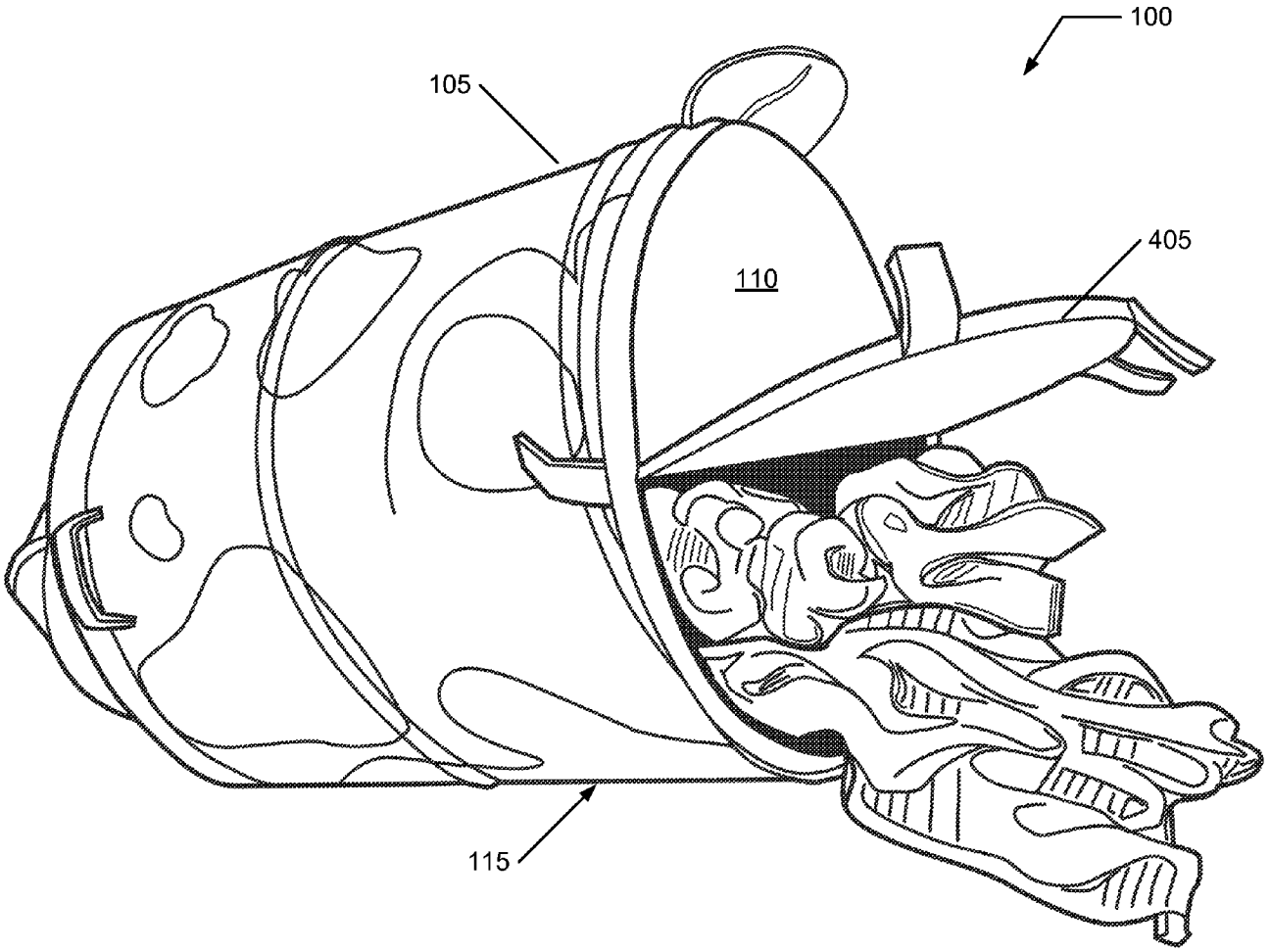
FIG. 4 illustrates a perspective view of the animated clothing hamper in an empty mode.
Figure 5:
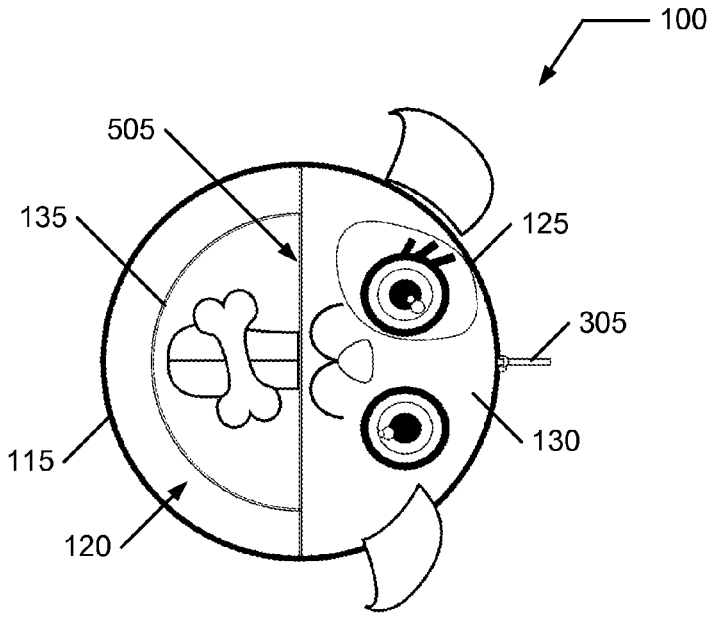
FIG. 5 illustrates a top plan view of the animated clothing hamper in the reception mode.
Figure 6:
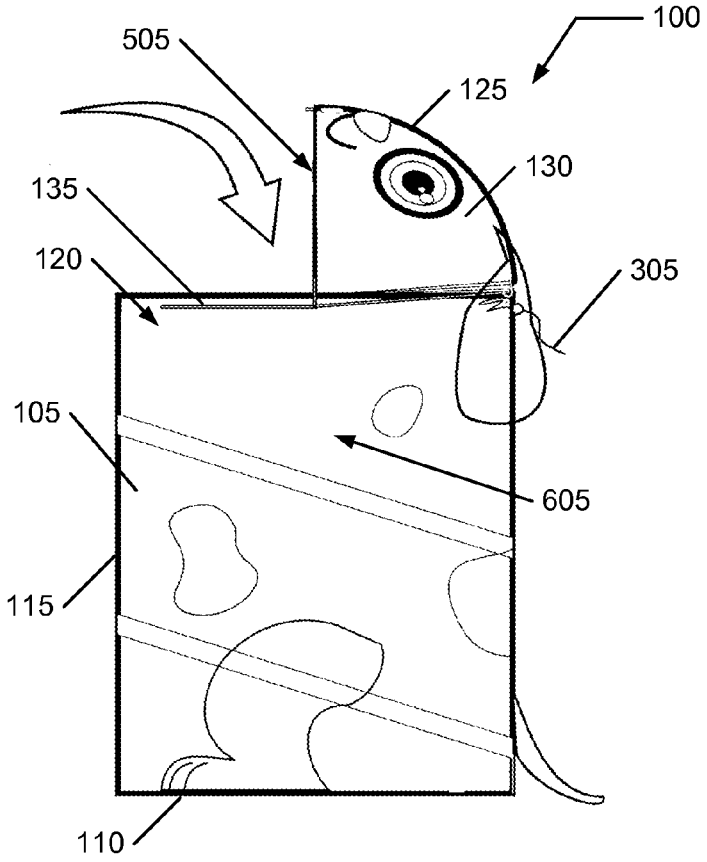
FIG. 6 illustrates a side elevation view of the animated clothing hamper in the reception mode.
Figure 7:
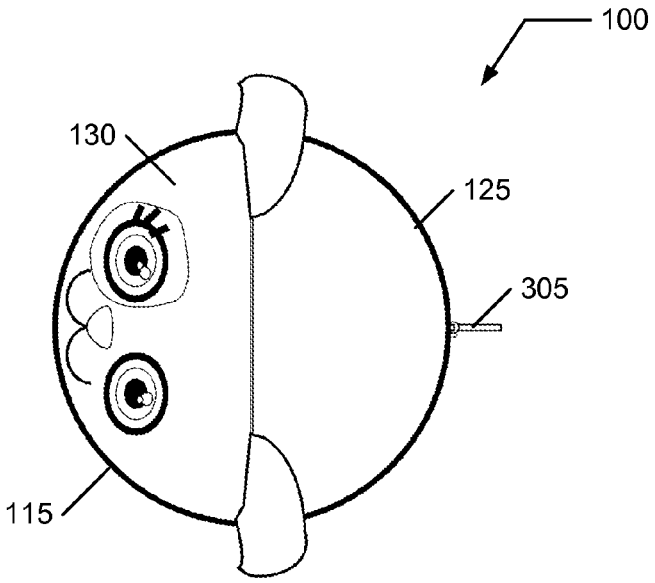
FIG. 7 illustrates a top plan view of the animated clothing hamper in the closed mode.
Figure 8:
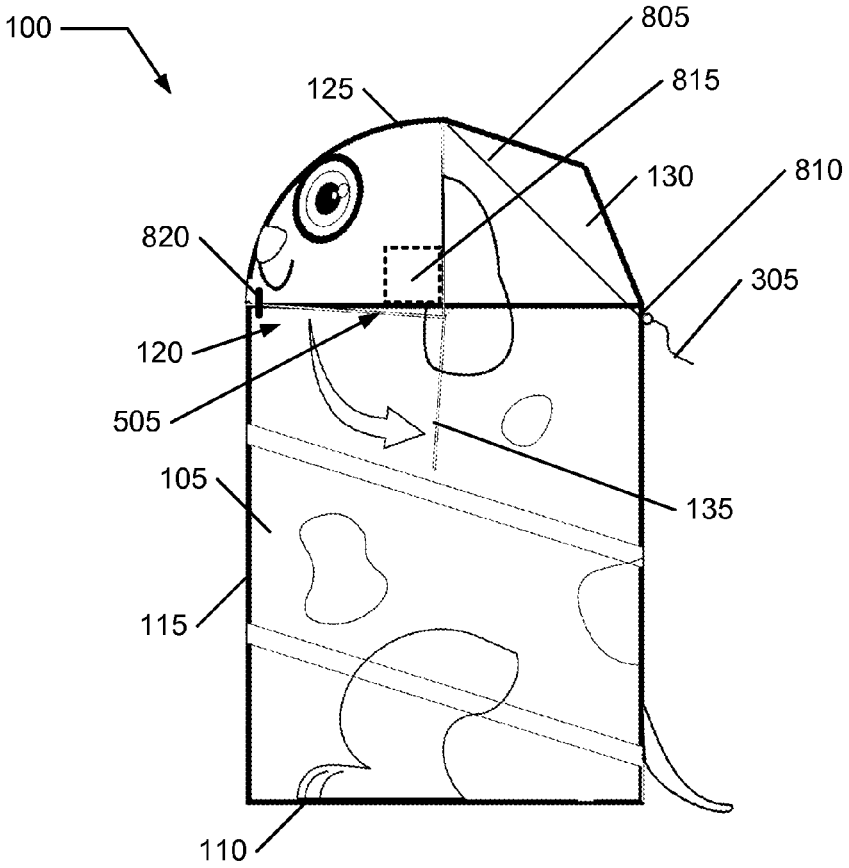
FIG. 8 illustrates a side elevation view of the animated clothing hamper in the closed mode.

FIG. 1 illustrates a front perspective view of an animated clothing hamper 100 in a reception mode; FIG. 2 illustrates a front perspective view of animated clothing hamper 100 in a closed mode; and FIG. 3 illustrates a rear perspective view of animated clothing hamper 100 in the closed mode. FIG. 4 illustrates a perspective view of animated clothing hamper 100 in an empty mode. FIG. 5 illustrates a top plan view of animated clothing hamper 100 in the reception mode and FIG. 6 illustrates a side elevation view of animated clothing hamper 100 in the reception mode. FIG. 7 illustrates a top plan view of animated clothing hamper 100 in the closed mode and FIG. 8 illustrates a side elevation view of animated clothing hamper 100 in the closed mode. Animated clothing hamper 100 includes a body housing 105 having a base 110 and including one or more sidewalls 115 extending away from base 110 defining an interior clothing-holding volume 605. Body housing 105 includes an opening 120 opposite of base 110 with opening 120 providing access into volume 605. A moveable flapper mechanism 125 is moveably (e.g., pivotally) coupled to body housing 105 at opening 120 and operates within opening 120 when moving between the reception mode (e.g., FIG. 1) and the closed mode (e.g., FIG. 2). The operation of flapper mechanism 125 of the illustrated embodiment is purposefully designed to be purely mechanical (electrically powered motors (line or battery energy sources) are not required for the clothing management functions) in its operation as described herein.

Flapper mechanism 125 includes a cover 130, a target panel 135, and an optional backstop 505 illustrated in FIG. 5 and FIG. 6. A biasing mechanism 305 (e.g., a spring, an elastomeric band, or the like) is coupled to flapper mechanism 125 to provide a restorative force that both returns flapper mechanism 125 to the reception when target panel 135 is not constrained and affects how strongly target panel 135 is pressed to move from the reception mode to the closed mode. As further explained below, the closed mode is also a configuration for depositing clothing received on target panel 135 into volume 605. Biasing mechanism 305 is illustrated as including an elastomeric band 805 and clamp 810 that controls a length of band 805 and an amount of stretch when moving from the reception mode to the closed mode, and hence a magnitude of the biasing/restorative force. This adjustment aids in tuning a desired animation pivot effect (e.g., speed of operation).

Flapper mechanism 125 may optionally include an F/X module 815 to provide an audio and/or visual effect associated with mode transitions or motion of target panel 135. F/X module 815 is responsive to operation of flapper mechanism 125 and may respond to transitions of target panel 135 between its modes. One transition may elicit one type of response and another transition may elicit another type of response (it being understood that the a response type may include a null operation in one type of transition). There are many ways to provide F/X module 815 having responsiveness to transitions of target panel 135, for example a contact switch may be strategically positioned on one of the components to detect motion of a sufficient magnitude. Small motions (e.g., rotations) of target panel 135 may not actuate the switch (open or close depending upon configuration) while larger motions may open or close the switch and enable the desired response from F/X module 815.

An optional latching system 820 (e.g., a strap or connector, such as a hook and loop fastening system) may be employed to allow flapper mechanism 125 to be maintained in the closed mode when animated clothing hamper 100 is not in use.

Base 110 optionally includes a bottom door 405 as part of base 110 that may be selectively opened to easily remove clothing deposited into volume 605. A similar latching mechanism as system 820 may be used to hold door 405 shut.

Housing 105 and cover 130 are illustrated as including a fabric shell stretched over a collapsible/spring steel frame though other implementations may provide alternative constructions. An advantage of this implementation is that housing 105 and cover 130 may be collapsed and flattened for storage, retail, distribution, and the like. This implementation also is constructed so that a resulting assembled housing 105 is flexible and noticeably sways and moves during operation of flapper mechanism 125 or when otherwise moved. This provides an alternative animation effect that helps to promote the playfulness impact of animated clothing hamper 100.

Further, as illustrated, housing 105 includes a cylinder configuration having a circular sidewall 115. Target panel 135 is generally semi-circular as it is pivotally coupled to sidewall 115 near opening 120 at diametrically-opposed pivot points. Target panel 135 is thus mechanically unbalanced in a sense of not requiring an electric motor for operation to deposit a load of soiled clothes into volume 605. A weight of the clothes that is sufficient to overcome the adjustable biasing force allows target panel 135 to transition to the closed mode and deposit the clothes. Once the weight of the clothes unloads from target panel 135, the biasing structure is able to restore target panel 135 to the reception mode. Backstop 505 provides a convenient location to attach elastic band 805 and cover 130 helps to conceal the mechanical operation and provide a more rewarding visual impression and protect the mechanical components from degradation, especially when operated by children. Different biasing systems and different flapper mechanisms may allow for a different configuration and arrangement of components. For example, housing 105 may have a different cross-section other than circular, e.g., square, elliptical, or the like. Target panel 135 typically will have a perimeter shape matching half of the cross-section.

A primary animation component of animated clothing hamper 100 includes a transition of the flapper mechanism 125 between its modes during setup, operation, and storage. In one representative use scenario, animated clothing hamper 100 is stored with flapper mechanism 125 in the closed mode, for example as illustrated in FIG. 2. When it is desired to enable flapper mechanism 125 for operation, latching system 820 releases flapper mechanism 125 and it transitions to the reception mode. In the reception mode, target panel 135 has moved into position within opening 120, for example generally parallel to base 110. Optional backstop 505, generally perpendicular to target panel 135 (though other angles more or less than ninety degrees are possible), helps to ensure that any article of clothing deposited onto target panel 135 is positioned for easy deposit into interior volume when flapper mechanism 125 transitions to the closed mode.

A child tossing, throwing, dropping, or otherwise placing a load of soiled clothing onto target panel 135 begins the transition of flapper mechanism 135 to the closed mode. That motion may include rotation of target panel 135 into interior volume 605 about a pivot that produces an increasingly-angled sloped ramp into interior volume 605. As illustrated, that angle may approach ninety degrees with respect to a plane including target panel 135 in the reception mode. In the motion between these extremes, an angle will be reached where the clothing loaded onto target panel 135 falls into interior volume 605. As illustrated, the angle extreme is influenced by the biasing mechanism. That is, with the elastic band, there is practically a maximum stretched length for any implementation, beyond which the band may fail and no longer impede or influence motion of flapper mechanism 125.

Once the soiled clothing has been deposited into interior volume 605, biasing mechanism 305 is able to restore flapper mechanism 125 to the reception mode, prepared for another cycle. The cycle of loading, deposition, and restoration continues until the user stops. To aid in accessing the clothing deposited into interior volume 605, the user may place housing 105 on its side and open door 405. Once emptied, door 405 may be re-closed and housing 105 placed upright in anticipation of more loading and deposition cycles.

Optional F/X module 815 is illustrated as responding to transitions of flapper mechanism 125. For example, an audio recording may be associated with a transition from the reception mode to the closed mode. For example, such an audio file may include a sound or sequence of sounds associated with consumption (e.g., an "eating" sound of biting, tearing, chewing, and the like). Alternatively or in addition, another sound or sequence of sounds may be associated with transition from the closed mode to the reception mode. The effects may alternatively, or in addition, include visual elements. For example, blinking eyes or the like.

At some point, the user may desire to store animated clothing hamper 100 in the closed mode. The user transitions flapper mechanism 125 to the closed mode and thereafter may use latching system 820 to maintain flapper mechanism in the closed mode against the restorative force from biasing mechanism 305.

To improve the playfulness factor, the illustrated embodiment includes a thematic implementation in which housing 105 and flapper mechanism 125 are produced in a way to be suggestive of an animal. As illustrated, thematic elements support a puppy theme with an addition of representative puppy elements such as colors, patterns, a tail, facial elements including eyes and ears. The theme may be extended onto decoration for flapper mechanism 125 such as including an image of a tongue and a bone within the "mouth" formed by an intersection of target panel 135 and backstop 505. When provided, optional F/X module 815 desirably provides appropriate supportive thematic effects.

Other themes may include real or imaginary creatures, such as reptiles, felines, canines, birds, monsters, and the like (each preferably having appropriately coordinated thematic elements).

The system and methods above has been described in general terms as an aid to understanding details of preferred embodiments of the present invention. In the description herein, numerous specific details are provided, such as examples of components and/or methods, to provide a thorough understanding of embodiments of the present invention. Some features and benefits of the present invention are realized in such modes and are not required in every case. One skilled in the relevant art will recognize, however, that an embodiment of the invention can be practiced without one or more of the specific details, or with other apparatus, systems, assemblies, methods, components, materials, parts, and/or the like. In other instances, well-known structures, materials, or operations are not specifically shown or described in detail to avoid obscuring aspects of embodiments of the present invention.

Reference throughout this specification to "one embodiment", "an embodiment", or "a specific embodiment" means that a particular feature, structure, or characteristic described in connection with the embodiment is included in at least one embodiment of the present invention and not necessarily in all embodiments. Thus, respective appearances of the phrases "in one embodiment", "in an embodiment", or "in a specific embodiment" in various places throughout this specification are not necessarily referring to the same embodiment. Furthermore, the particular features, structures, or characteristics of any specific embodiment of the present invention may be combined in any suitable manner with one or more other embodiments. It is to be understood that other variations and modifications of the embodiments of the present invention described and illustrated herein are possible in light of the teachings herein and are to be considered as part of the spirit and scope of the present invention.

It will also be appreciated that one or more of the elements depicted in the drawings/figures can also be implemented in a more separated or integrated manner, or even removed or rendered as inoperable in certain cases, as is useful in accordance with a particular application.

Additionally, any signal arrows in the drawings/Figures should be considered only as exemplary, and not limiting, unless otherwise specifically noted. Combinations of components or steps will also be considered as being noted, where terminology is foreseen as rendering the ability to separate or combine is unclear.

The foregoing description of illustrated embodiments of the present invention, including what is described in the Abstract, is not intended to be exhaustive or to limit the invention to the precise forms disclosed herein. While specific embodiments of, and examples for, the invention are described herein for illustrative purposes only, various equivalent modifications are possible within the spirit and scope of the present invention, as those skilled in the relevant art will recognize and appreciate. As indicated, these modifications may be made to the present invention in light of the foregoing description of illustrated embodiments of the present invention and are to be included within the spirit and scope of the present invention.

Thus, while the present invention has been described herein with reference to particular embodiments thereof, a latitude of modification, various changes and substitutions are intended in the foregoing disclosures, and it will be appreciated that in some instances some features of embodiments of the invention will be employed without a corresponding use of other features without departing from the scope and spirit of the invention as set forth. Therefore, many modifications may be made to adapt a particular situation or material to the essential scope and spirit of the present invention. It is intended that the invention not be limited to the particular terms used in following claims and/or to the particular embodiment disclosed as the best mode contemplated for carrying out this invention, but that the invention will include any and all embodiments and equivalents falling within the scope of the appended claims. Thus, the scope of the invention is to be determined solely by the appended claims.

What is claimed as new and desired to be protected by Letters Patent of the United States is:

1. A method, comprising the steps of:

a) adding an article of clothing onto a target panel pivotally coupled within an opening, said opening accessing a storage volume of a clothing hamper, said target panel including a reception mode for receipt of said article of clothing wherein said reception mode includes a first portion of said target panel disposed generally horizontally and presenting a partial horizontal closure of said opening and including a top horizontal surface supporting said article of clothing and wherein said reception mode includes a second portion of said target panel disposed generally at right angles to said first portion and extending generally vertically away from said first portion;

b) inclining, without use of an electric motor, said target panel into said storage volume responsive to said article of clothing added onto said target panel, said target panel including a closed mode for depositing said article of clothing into said storage volume by sloping said top surface into said storage volume and wherein said closed mode rotates said second portion to closure of said opening;

c) depositing said article of clothing into said storage volume responsive to said inclination of said target panel in said closed mode; and d) declining, without use of an electric motor, said target panel from said storage volume responsive to said article of clothing being deposited into said storage volume until said target panel returns automatically to said reception mode.

2. The method of claim 1 wherein said inclining step b) activates a biasing structure coupled between an exterior wall of said clothing hamper and said second portion and wherein said declining step d) includes returning said target panel to said reception mode responsive automatically to said biasing structure.

3. The method of claim 2 wherein said biasing structure includes an elastic band extending between said exterior wall and said second portion.

4. The method of claim 1 wherein said storage hamper includes an access port in a base surface, said base surface opposite of said opening, further comprising:

e) removing said article of clothing from within said storage volume through said port.

5. The method of claim 3 wherein said storage hamper includes an access port in a base surface, said base surface opposite of said opening, further comprising:

e) removing said article of clothing from within said storage volume through said port.

* * * * *